US006113027A

United States Patent [19]

Redford

[11] Patent Number: 6,113,027

[45] Date of Patent: Sep. 5, 2000

[54] FLIGHT LAUNCHED FIBER OPTIC DUAL PAYOUT SYSTEM

[75] Inventor: Gary R. Redford, Tucson, Ariz.

[73] Assignee: Raytheon Company, Lexington, Mass.

[21] Appl. No.: 07/851,721

[22] Filed: Mar. 16, 1992

[51] Int. Cl.[7] ..... F41G 7/32

[52] U.S. Cl. ..... 244/3.12

[58] Field of Search ..... 244/3.12; 102/504; 89/1.34

[56] References Cited

U.S. PATENT DOCUMENTS

| | | | |
|---|---|---|---|
| 4,860,968 | 8/1989 | Pinson | 244/3.12 |
| 4,967,980 | 11/1990 | Pinson | 244/3.12 |
| 5,005,930 | 4/1991 | Schotter | 244/3.12 X |
| 5,031,982 | 7/1991 | Redford | 350/96.1 |
| 5,031,997 | 7/1991 | Redford et al. | 244/3.16 |
| 5,040,744 | 8/1991 | LeCompte | 244/3.12 |

*Primary Examiner*—Harold J. Tudor
*Attorney, Agent, or Firm*—David W. Collins; Andrew J. Rudd; Glenn H. Lenzen, Jr.

[57] ABSTRACT

A flight launched fiber optic dual payout system (10) for a command guided missile (12) is disclosed which combines a missile (12) with two fiber optic cable dispensers (18, 20) into a single unit that can mount to a single launch station of a launch platform (14). The dual payout system (10) of the present invention includes a missile (12) having a missile dispenser (18) for dispensing a first fiber optic cable (22) connected to the missile (12) and a launch platform dispenser (20) for dispensing a second fiber optic cable (24) detachably connected to the missile dispenser (20). The first and second fiber optic cables (22, 24) are connected by a length of reinforced cable splice or leader line (26) which is housed in a protective retainer (28) on a launch platform interface unit (16) that operates to mount the missile (12) to the launch platform (14) and complete a fiber optic data link between the missile (12) and the launch platform (14). In a "launch-ready" position, the launch platform interface unit (16) separates the launch platform dispenser (20) from the missile dispenser (18) to facilitate payout of the fiber optic cable (22, 24). Upon missile launch, the launch platform dispenser (20) is retained with the launch platform (14). Further, the launch platform interface unit (16) provides a universal interface (36) for attaching any given command guided missile (12) to variety of high-speed, mobile launch platforms (14) such as aircraft and helicopters.

19 Claims, 3 Drawing Sheets

FLIGHT LAUNCHED FIBER OPTIC DUAL PAYOUT SYSTEM

BACKGROUND OF THE INVENTION

1. Technical Field

This invention relates to fiber optic cable payout systems for command guided missiles and, more particularly, to a flight launched fiber optic dual payout system.

2. Discussion

In certain command guided missile systems, a long, small diameter, fiber optic cable is utilized to maintain a data link between the missile and its point of launch, or launch platform, throughout the flight of the missile. The fiber optic data link (FODL) facilitates jam-free command communications between the missile and the launch platform's fire control system and allows the guidance of the missile to be remotely controlled by commands originating from the launch platform.

However, fiber optic data links require that the fiber optic cable, itself, be stationary relative to the air through which the missile is traveling, as opposed to being dragged through the air behind the missile. This is due to the fact that at missile velocities, if the cable were dragged behind the missile, the aerodynamic force exerted on the cable (i.e. drag force) would, after a short distance such as a few hundred feet, for example, be sufficient to break the cable and interrupt the fiber optic data link. For this reason, the fiber optic cable is dispensed or "paid out" in the air behind the missile by a missile dispenser which is part of a "fiber optic payout system."

If the launch platform is also moving relative to the air when the missile is launched, as in missiles launched from aircraft, the launch platform must also have a dispenser to pay out the fiber optic cable, in addition to the missile dispenser. The combination of the two dispensers, together with any corresponding mechanical, electrical and optical components, constitute a "fiber optic dual payout system."

To date, experimental flight launched fiber optic dual payout systems employ the ordnance (i.e. the missile) and a data-link pod on two separate launch stations of the launch platform (i.e. wing stations on the aircraft), each having a dispenser for paying out the fiber optic cable. The fiber optic cables in the separate dispensers on the ordnance and the pod are connected by a reinforced cable splice, or "ruggedized" leader line, which is installed at the time the ordnance is mounted on the aircraft. However, these experimental systems have presented several design difficulties, such as how to store and protect the leader line during the flight of the launch platform, which may reach mach velocities, as well as how to release the leader line from storage just prior to missile launch. Further, these systems require the additional installation step of connecting the leader line between the ordnance and the data-link pod at the time that the ordnance is mounted on the aircraft. Still further, these systems have inherently limited the ordnance payload which may be carried on the launch platform because two launch stations on the launch platform are required for each single ordnance.

SUMMARY OF THE INVENTION

According to the teachings of the present invention, a flight launched fiber optic dual payout system for a command guided missile is disclosed which combines a missile with two fiber optic cable dispensers into a single unit that can mount to a single launch station of a launch platform.

The dual payout system of the present invention includes a missile having a missile dispenser for dispensing a first fiber optic cable connected to the missile and a launch platform dispenser for dispensing a second fiber optic cable detachably connected to the missile dispenser. The first and second fiber optic cables are connected by a length of reinforced cable splice which is housed in a protective retainer on a launch platform interface unit that operates to mount the missile to the launch platform and complete a fiber optic data link between the missile and the launch platform. In a "launch-ready" position, the launch platform interface unit separates the launch platform dispenser from the missile dispenser to facilitate payout of the fiber optic cable. Upon missile launch, the launch platform dispenser is retained with the launch platform. Further, the launch platform interface provides a universal interface for attaching any given command guided missile to variety of high-speed, mobile launch platforms such as aircraft and helicopters.

BRIEF DESCRIPTION OF THE DRAWINGS

The various advantages of the present invention will become apparent to one skilled in the art upon reading the following specification, in which.

DESCRIPTION OF THE PREFERRED EMBODIMENT

It should be understood from the outset that while the following discussion illustrates a particular embodiment of the present invention, this embodiment merely represents a best mode of currently practicing the invention and other modifications may be made to the particular embodiment discussed without departing from the spirit and scope of the invention.

Figure 1:
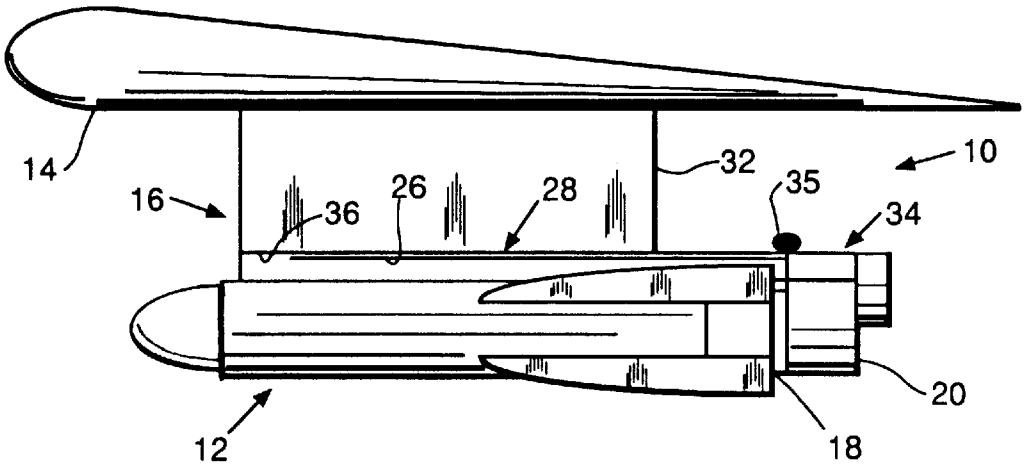
FIG. 1 shows a simplified illustration of a side view of the flight launched fiber optic dual payout system of the present invention.
Figure 2:
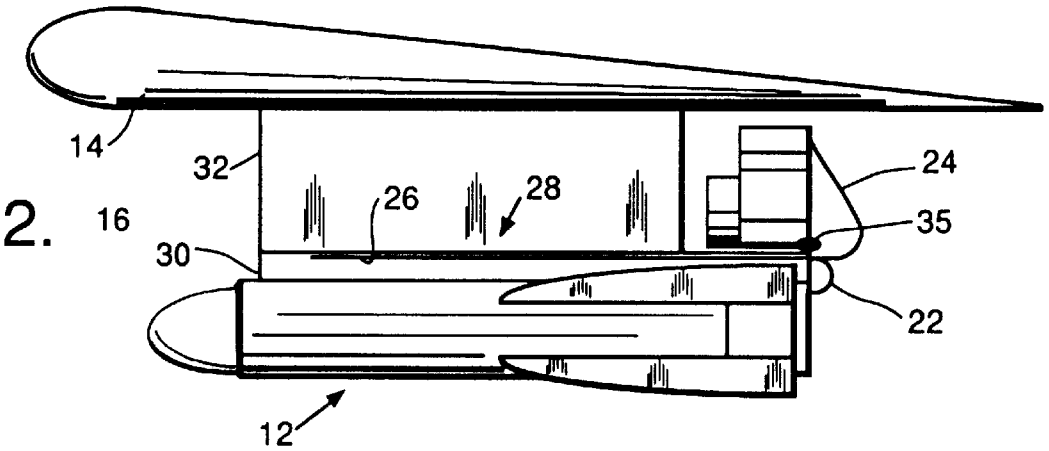
FIG. 2 shows the dual payout system of FIG. 1 in a "launch-ready" position.

The flight launched fiber optic dual payout system 10 of the present invention is illustrated in FIGS. 1 and 2. As shown in FIG. 1, the dual payout system 10 includes a command guided missile 12 which is mounted to a launch platform 14 by a launch platform interface unit 16. The missile 12 is shown as having two fiber optic cable dispensers, a missile dispenser 18 and a launch platform dispenser 20.

As best seen in FIGS. 1 and 2, the missile dispenser 18 is an integral component of the missile 12 and the launch platform dispenser 20 is detachably connected to the missile dispenser 18 and may be removed entirely from the missile 12, as will be described in detail below. The fiber optic cables 22, 24 of the respective dispensers 18, 20, best seen in FIGS. 2–7, are connected by a cable splice or leader line 26. The leader line 26 is a length of reinforced fiber optic cable and is housed in a protective retainer 28 which runs along the axial length of the launch platform interface unit 16.

Also shown in FIGS. 1 and 2, the launch platform interface unit 16 generally includes two main components, the launch platform mechanical unit (LMU) 30 and the launch platform electronic unit (LEU) 32.

The LMU 30 is located at the bottom half of the launch platform interface unit 16 and provides a mounting location for the command guided missile 12 and the launch platform dispenser 20. The LMU 30 also includes a hinge 35 and end portion 34 which operates to detach and rotate the launch platform dispenser 20 to a "launch-ready" position prior to the launch of the missile 12 and, further, to retain the launch platform dispenser 20 subsequent to the launch of the missile 12.

The LEU 32, in turn, is positioned at the top half of the launch platform interface unit 16 and attaches to the launch platform 14. The LEU 32 not only possesses the mechanical interface required to mount to the launch platform 14, but also provides the necessary electrical and optical connections which complement the launch platform's fire control system to enable the launch platform interface unit 16 to complete a fiber optic data link between the missile 12 and the launch platform 14. The electrical and optical connections could include a variety of connectors well-known in the art, such as connectors for a laser transmitter, laser transmitter/receiver, video processor, tracker, command module, recorder, or any combination thereof that may be desired.

The connection between the LMU 30 and the LEU 32 is a universal interface 36 which allows any LMU 30 designed for carrying a particular missile 12 to be attached to any LEU 32 designed for mounting to a particular launch platform 14. It should be appreciated that the universal interface 36 provides maximum flexibility in adapting any missile 12 utilizing the flight launched fiber optic dual payout system 10 of the present invention for use with any variety of launch platforms 14, such as high speed, mobile launch platforms like aircraft and helicopters.

An example of the operation of the flight launched dual payout system 10 of the present invention is illustrated in FIGS. 1–6. As shown in FIG. 1, the command guided missile 12 configured with the dual payout system 10 of the present invention is mounted to the LMU 30. The LMU 30, in turn, mounts to the LEU 32 which attaches to a single launch station of an aircraft and provides an electrical and/or optical connection with the aircraft's fire control system.

Just prior to missile launch, the launch platform fire control system instructs the launch platform interface 16 to ready the missile 12 for firing with the "missile arm" command. Next, the end portion 34 of the LMU 30 operates to "unlock" and separate the launch platform dispenser 20 from the missile 12 by detaching it from the missile dispenser 18 and rotating it about the hinge 35 to a "launch-ready" position as shown in FIG. 2. In the launch-ready position, both the missile dispenser 18 and the launch platform dispenser 20 are directed in the aft direction (with respect to the launch platform 14) to facilitate payout of the fiber optic cables 22, 24. In addition, the launch platform dispenser 20 is secured to the launch platform interface 16 by means of the end portion 34 of the LMU 30 so as to be retained therewith subsequent to missile launch.

Figure 3:
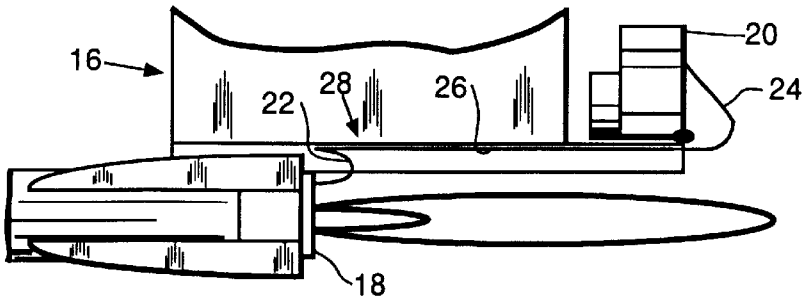
FIG. 3 shows the dual payout system of FIG. 1 with the missile launch motor ignited.
Figure 4:
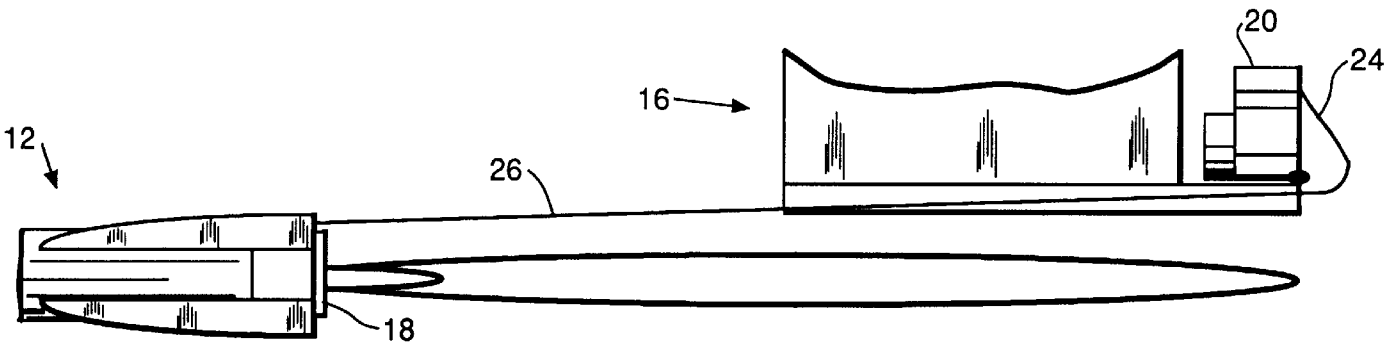
FIG. 4 shows the dual payout system of FIG. 1 in a "leader-deployed" position.
Figure 5:
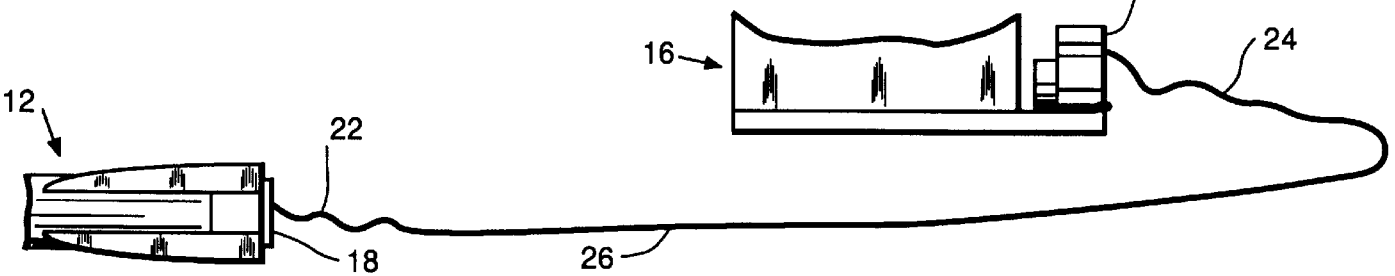
FIG. 5 shows the dual payout system of FIG. 1 as it begins to dispense a fiber optic cable.
Figure 6:
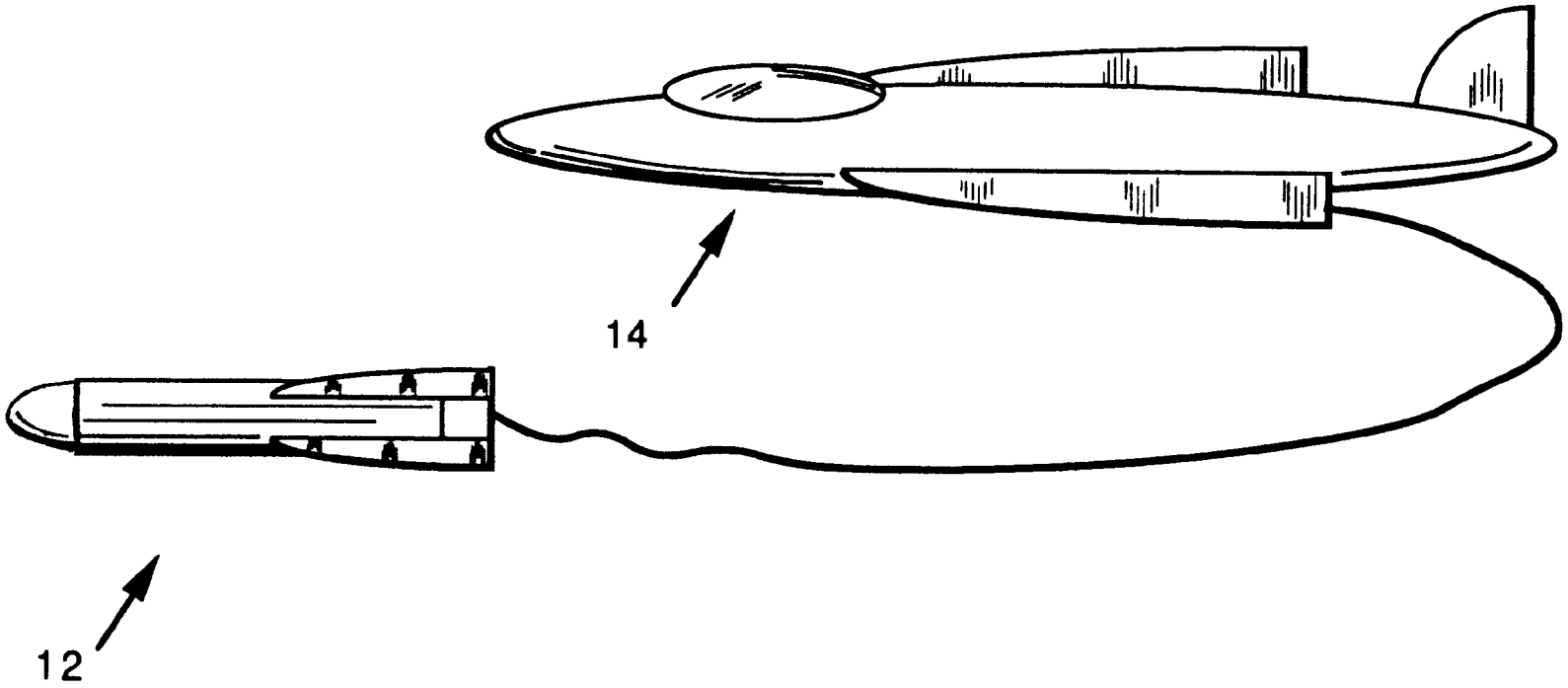
FIG. 6 shows an aircraft launching a command guided missile having the dual payout system of FIG. 1.

As the missile's launch motor is ignited, as shown in FIG. 3, the fiber optic cables 22, 24 are shielded from the ignition blast by the protective retainer 28 which houses the leader line 26. As the missile 12 is launched, the leader line 26 is "peeled" from the launch platform interface 16 and is removed from the protective retainer 28. When fully removed, the leader line 26 is in a "leader-deployed" position, as best illustrated in FIG. 4. As shown in FIGS. 5 and 6, the deployed leader line 26 eventually becomes taught, and payout from both the missile dispenser 18 and launch platform dispenser 20 is initiated.

It should be appreciated that the present invention can be used with missiles having both short burn and long burn (i.e. a few seconds) launch motors. Further, a sustained launch missile can be used with the present invention in combination with a launch platform dispenser that takes advantage of "ducted payout," which shields the fiber optic cable from the missile's launch motor ignition blast by a flexible duct which extends behind the launch platform dispenser, such as is disclosed in U.S. patent application Ser. No. 07/527,619 filed May 23, 1990 now U.S. Pat. No. 5,031,982 issued Jul. 16, 1991 and assigned to the assignee of the present invention.

Also, the present invention can be used in conjunction with a "glide bomb" and can mount to a simplified launch station, such as bomb lugs, for example.

In addition, payout from the missile dispenser 18 and the launch platform dispenser 20 may be accomplished in either of two manners well-known in the art. One manner is described as passive, such as using the force of the airstream, which generates aerodynamic drag on the leader line 26, to result in payout of the fiber optic cable from both the missile dispenser and the launch platform dispenser. The other manner is known as active and employs the use of a squib, or some other device known in the art, to "cast" the fiber optic cables 22, 24 from the respective dispensers.

It should be understood that the present invention is expected to achieve the advantage of requiring only a single launch station on the launch platform to mount a flight launched fiber optic dual payout system for a command guided missile, instead of two stations which are necessary with present experimental dual payout systems. Another expected advantage of the present invention is that the dual payout system will be more reliable and will protect the leader line that connects the fiber optic cables in each of the payout dispensers. A further expected advantage of the invention herein disclosed is that the missile includes both the launch platform fiber optic cable dispenser as well as the missile fiber optic cable dispenser for a dual payout system, and therefore the leader line connecting the two dispensers would not have to be installed or connected at the time the ordnance is mounted on the aircraft, but could be incorporated into a single unit providing a more reliable and easier to load payout system. A still further expected advantage of the present invention is that the two piece launch platform interface allows a given missile to interface with a variety of launch platforms so that those capabilities required to implement the fiber optic data link are readily available.

Various other advantages and modifications will become apparent to one skilled in the art after having the benefit of studying the teachings of the specification, the drawings, and the following claims.

What is claimed is:

1. A flight launched fiber optic dual payout system for a command guided missile, comprising:

(a) missile dispenser means connected to said missile for dispensing a first fiber optic cable from said command guided missile;

(b) launch platform dispenser means detachably connected to said missile dispenser means for dispensing a second fiber optic cable from a launch platform, said launch platform dispenser means being retained with a launch platform subsequent to the launch of said command guided missile;

(c) connection means for connecting said first fiber optic cable to said second fiber optic cable; and (d) launch platform interface means connected to said launch platform for mounting said missile to said launch platform and completing a fiber optic data link between said command guided missile and said launch platform;

said launch platform interface means including means for detaching said launch platform dispenser means from said missile dispenser means and rotating said launch platform dispenser means to a ready position such that both said missile dispenser means and said launch platform dispenser means are directed aft just prior to the launch of said command guided missile.

2. The fiber optic dual payout system of claim 1 wherein said missile dispenser means and said launch platform dispenser means dispense said first and second fiber optic cables passively.

3. The fiber optic dual payout system of claim 1 wherein said missile dispenser means and said launch platform dispenser means dispense said first and second fiber optic cables actively.

4. The fiber optic dual payout system of claim 1 wherein said connection means for connecting said first fiber optic data link to said second fiber optic data link comprises a reinforced cable splice.

5. The fiber optic dual payout system of claim 4 wherein said reinforced cable splice is housed in a protective retainer located on said launch platform interface means.

6. The fiber optic dual payout system of claim 1 wherein said launch platform interface means comprises a launch platform mechanical unit and a launch platform electronic unit.

7. The fiber optic dual payout system of claim 6 wherein said launch platform mechanical unit comprises means to mount said command guided missile thereto.

8. The fiber optic dual payout system of claim 7 wherein said means to rotate said launch platform dispenser means to a ready position comprises hinge means.

9. The fiber optic dual payout system of claim 6 wherein said launch platform electronic unit comprises means to mount to said launch platform, means to mount said launch platform mechanical unit thereto and means to complete said fiber optic data link.

10. The fiber optic dual payout system of claim 9 wherein said means to mount said launch platform mechanical unit to said launch platform electronic unit comprises a universal interface enabling a variety of command guided missiles to be mounted to a given launch platform.

11. The fiber optic dual payout system of claim 1 wherein said command guided missile has a launch motor selected from the group consisting of short burn, long burn and sustained launch types.

12. The fiber optic dual payout system of claim 1 wherein said command guided missile is a glide bomb.

13. A flight launched fiber optic dual payout system for a command guided missile, comprising:

(a) a command guided missile having a first dispenser for dispensing a first fiber optic cable and a second dispenser for dispensing a second fiber optic cable, said first dispenser being integrally connected to said command guided missile and said second dispenser being detachably connected to said first dispenser;

(b) a launch platform mechanical unit having hinge means coupled to said second dispenser and means for mounting said command guided missile thereto, said launch platform mechanical unit being capable of detaching said second dispenser from said first dispenser, rotating said second dispenser to a ready position just prior to the launch of said command guided missile and retaining said second dispenser subsequent to the launch of said command guided missile; and (c) a launch platform electronic unit having means to mount to said launch platform, means to mount said launch platform mechanical unit thereto and means to complete a fiber optic data link between said command guided missile and said launch platform, said means to mount said launch platform mechanical unit being a universal interface which enables a variety of command guided missiles to be mounted to a given launch platform.

14. The fiber optic dual payout system of claim 13 wherein said missile dispenser means and said launch platform dispenser means dispense said first and second fiber optic cables passively.

15. The fiber optic dual payout system of claim 13 wherein said missile dispenser means and said launch platform dispenser means dispense said first and second fiber optic cables actively.

16. The fiber optic dual payout system of claim 13 wherein said connection means for connecting said first fiber optic data link to said second fiber optic data link comprises a reinforced cable splice, said reinforced cable splice being housed in a protective retainer located on said launch platform interface means.

17. The fiber optic dual payout system of claim 13 wherein said command guided missile is selected from the group consisting of short burn, long burn and sustained launch types.

18. The fiber optic dual payout system of claim 13 wherein said command guided missile is a glide bomb.

19. A method of implementing a flight launched fiber optic dual payout system for a command guided missile, comprising the steps of:

(a) mounting launch platform interface means to a mobile launch platform;

(b) mounting an ordnance having first dispenser means for dispensing a first fiber optic cable and second dispenser means for dispensing a second fiber optic cable to said launch platform interface means, said second dispenser means being detachably connected to said first dispenser means and said first fiber optic cable being connected to said second fiber optic cable by a reinforced cable splice;

(c) completing a fiber optic data link between said ordnance and said launch platform;

(d) detaching said second dispenser means from said first dispenser means and rotating said second dispenser means to a ready position just prior to the launch of said ordnance such that both said first dispenser and said second dispenser are directed aft;

(e) launching said ordnance; and (f) dispensing said first fiber optic cable from said first dispenser means and dispensing said second fiber optic cable from said second dispenser means.

* * * * *